US006955234B1

(12) United States Patent
Mathews

(10) Patent No.: US 6,955,234 B1
(45) Date of Patent: Oct. 18, 2005

(54) AUGER BIT

(75) Inventor: Donald Mathews, Godwin, NC (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/657,406

(22) Filed: Sep. 8, 2003

Related U.S. Application Data

(62) Division of application No. 09/982,729, filed on Oct. 18, 2001, now Pat. No. 6,675,916.

(60) Provisional application No. 60/248,158, filed on Nov. 13, 2000.

(51) Int. Cl.[7] ..... E21B 10/26
(52) U.S. Cl. ..... 175/388; 175/385; 175/394
(58) Field of Search ..... 175/323, 102, 175/388, 394, 385, 386

(56) References Cited

U.S. PATENT DOCUMENTS 2,401,250 A * 5/1946 Kandle ..... 175/394
2,650,083 A * 8/1953 Robbins ..... 175/394
2,688,465 A * 9/1954 Birdwell ..... 175/388
2,749,102 A * 6/1956 Goodrich ..... 175/394
2,838,285 A * 6/1958 Gredell ..... 175/394
3,092,190 A * 6/1963 Gruere ..... 175/323
3,508,622 A * 4/1970 Sturgeon et al. ..... 175/388

* cited by examiner

*Primary Examiner*—David Bagnell
*Assistant Examiner*—Matthew J. Smith
(74) *Attorney, Agent, or Firm*—Walters & Zimmerman

(57) ABSTRACT

An auger has an outer blade and a center bit. The outer blade includes an outer ring and an inner hub, and the center bit inserts into the inner hub. The outer ring has an array of circumferentially-spaced teeth, and the inner hub is inwardly spaced from the outer ring by an array of inner spokes. Each spoke in the array of inner spokes also has a bladed portion for removing material. The center bit has a drill bit-shaped tip, a toothed cone, and a shaft all concentrically aligned with the outer ring and with the inner hub. The toothed cone includes at least one blade outwardly protruding from the toothed cone, and the shaft inserts into the inner hub to center the center bit with the outer ring and with the inner hub. The drill bit-shaped tip centers the auger bit, and the array of circumferentially-spaced teeth moves soil and cuts roots. The at least one blade outwardly protruding from the toothed cone also moves soil and cuts roots.

3 Claims, 14 Drawing Sheets

AUGER BIT

CROSS-REFERENCE TO RELATED APPLICATIONS

This patent application clams the benefit of U.S. Provisional Patent Application No. 60/248,158, filed Nov. 13, 2000, and incorporated herein by reference in its entirety.

This application is also a divisional of U.S. application Ser. No. 09/982,729, filed Oct. 18, 2001 now U.S. Pat. No. 6,675,916 and entitled "Boring Machine and Auger Bit," of which the "Brief Summary of the Invention" and the "Detailed Description of the Invention" sections are incorporated by reference.

BACKGROUND OF THE INVENTION

1. Field of the Invention

This invention generally relates to boring machines and, more particularly, to a bit for an auger.

2. Description of the Related Art

Digging post holes in the ground is particularly troublesome. Post holes are often dug by hand or by using a power auger. A common residential fence project, for example, often requires fifty (50) to one hundred (100) post holes. Manually digging these post holes is a very slow process and often fraught with work site injuries. Manually digging is thus often prohibitively expensive and avoided.

Power augers also present problems. One type of power auger requires two (2) operators. The operators hold the power auger while a gas engine turns the auger. These types of power augers, however, are very dangerous. The auger often binds against large rocks and tree roots. The auger then "kicks" or jerks against the rock or root. This kicking or jerking action frequently results in operator injury. Many operators, in fact, have suffered broken arms and/or ribs when a power auger binds.

Another type of prior art auger is designed as an implement for backhoes and skid-steer loaders. These augers mount as an attachment. While these auger implements are a safer alternative to hand-operated augers, these auger implements have other problems. One problem is the arcing movement of the attachment design. Because the auger mounts to the backhoe's bucket or boom attachment, the auger bores with an arcing motion. The backhoe or skid-steer boom design prevents the auger from boring a straight hole. This is especially problematic when deep holes are required for light poles, telephone poles, and other deeply secured objects.

Another problem with the prior art auger machines is landscape damage. Skid-steer equipment skids when turning. One bank of wheels turns while an opposite bank is locked. The resulting motion then skids across grass, mulching, or other landscaping. This skidding action damages the landscape and often requires sod repair or replacement. These auger implements unnecessarily increase the cost of fencing projects.

Still another problem with the prior art is maneuverability. The prior art auger machines are not maneuverable and, thus, imprecise. The prior art auger machines have large support structures that limit maneuverability in corners, in tight confines, and on hillsides. Many auger machines, in fact, cannot be positioned along tight fence lines, forcing operators to manually dig post holes. Many prior art auger machines are also not stable on hillsides, further compromising both precision and operator safety.

U.S. Pat. No. 5,090,486 to Jones (issued Feb. 25, 1992) is one example of a prior art auger machine. The auger of this design is supported by a heavy steel housing with a pair of feet. The auger is vertically driven by a pair of hydraulic cylinders. Because the Jones prior art design requires both feet to be positioned for vertical support, this prior art design is not maneuverable, nor accurate, on hillsides. This design, moreover, cannot bore a vertical hole on hillsides.

U.S. Pat. No. 5,363,925 to Gallagher (issued Nov. 15, 1994) is another prior art example. Although the Gallagher design is intended for small all-terrain vehicles, the design still suffers from imprecision. The single support drill beam allows access to confined regions and corners, yet the chain drive is prone to stretching and breaking. The Gallagher design also cannot bore a vertical hole on hillsides.

There is, accordingly, a need in the art for an auger that is safe to use with a reduce risk of operator injury, that is time efficient and cost effective to operate, that bores a straight hole, that operates on an incline, and that reduces or eliminates yard damage.

BRIEF SUMMARY OF THE INVENTION

The aforementioned problems are reduced by the present invention. The present invention is an auger bit for improved movement of soil and for improved cutting of roots. The auger bit has an outer blade and a center bit. The outer blade includes an outer ring and an inner hub, and the center bit inserts into the inner hub. The outer ring has an array of circumferentially-spaced teeth, and the inner hub is inwardly spaced from the outer ring by an array of inner spokes. Each spoke in the array of inner spokes also has a bladed portion for removing material. The center bit has a drill bit-shaped tip, a toothed cone, and a shaft all concentrically aligned with the outer ring and with the inner hub. The toothed cone includes at least one blade outwardly protruding from the toothed cone, and the shaft inserts into the inner hub to center the center bit with the outer ring and with the inner hub. The drill bit-shaped tip centers the auger bit, and the array of circumferentially-spaced teeth moves soil and cuts roots. The at least one blade outwardly protruding from the toothed cone also moves soil and cuts roots.

BRIEF DESCRIPTION OF THE SEVERAL VIEWS OF THE DRAWINGS

These and other features, aspects, and advantages of the present invention are better understood when the following Detailed Description of the Invention is read with reference to the accompanying drawings, wherein.

DETAILED DESCRIPTION OF THE INVENTION

Figure 1:
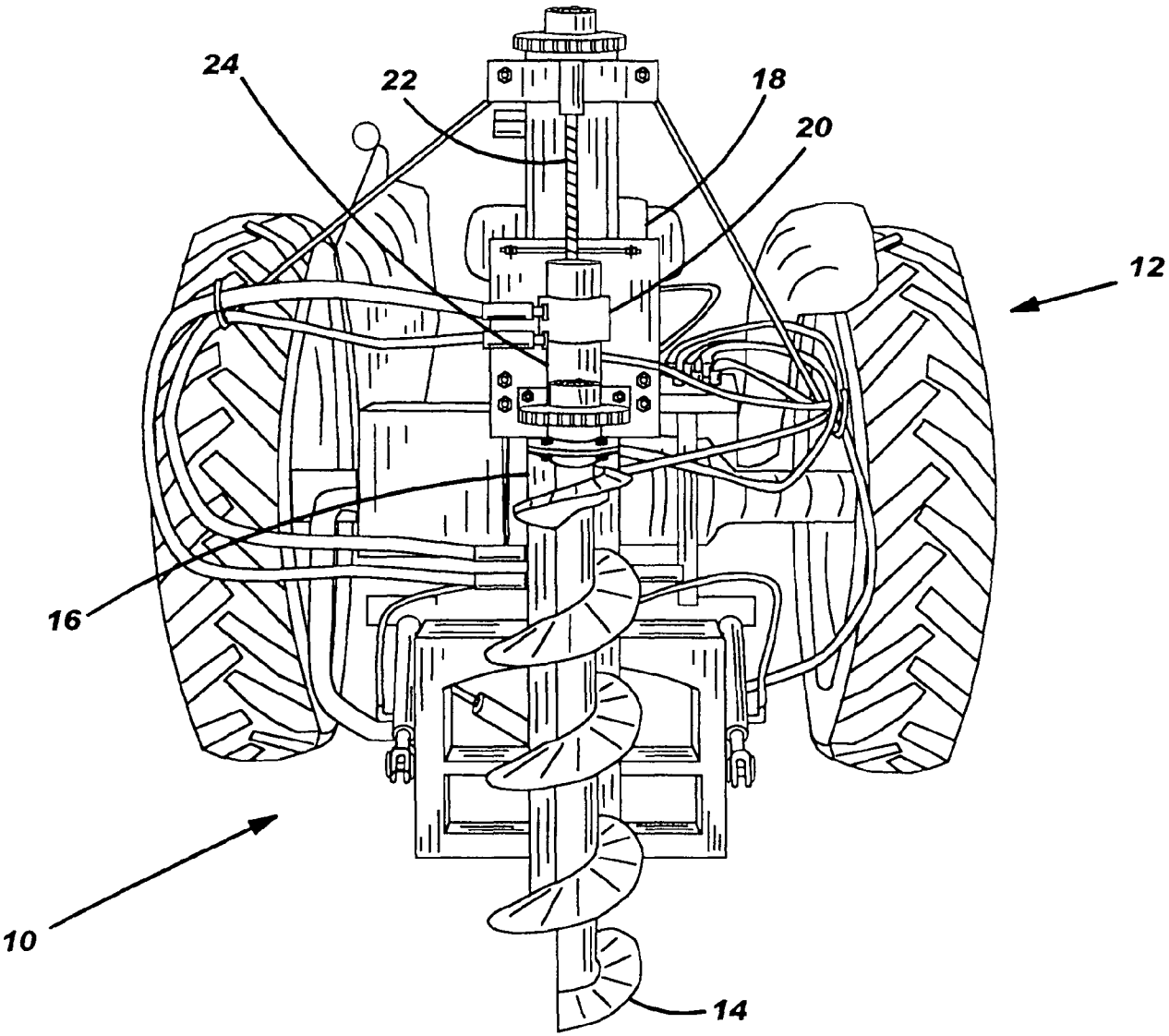
FIG. 1 is a schematic of a boring machine attached to a farm tractor.

The present invention particularly relates to a boring machine for boring holes in the ground. The boring machine includes an auger translating along a guide. Because the auger translates along the guide, the auger bores a straight hole in the ground. The boring machine thus eliminates the arcing motion of conventional boring machines and boring implements.

One embodiment of the present invention describes a posthole digger for boring a hole. An auger translates along a single guide member. A power screw system translates the auger. The power screw system comprises a single threaded screw, a slider mechanism, and means for rotating the single threaded screw. Means for rotating the auger is also included. The slider mechanism slides along the single guide member with the auger rotationally mounted to the slider mechanism. The single threaded screw is oriented substantially parallel to the single guide member and threadably engages the slider mechanism. Rotational motion of the single threaded screw causes the slider mechanism to slide along the single guide member, to rectilinearly translate the auger, and to vary the depth of the bored hole. The single supporting guide member and the single threaded screw improve maneuverability and accuracy.

Another embodiment discloses a posthole digger for boring a hole in the earth. The posthole digger mounts to a vehicle. An auger rectilinearly translates along a single guide member. A power screw system rectilinearly translates the auger. The power screw system comprises a single threaded screw, a slider mechanism, and a means for rotating the single threaded screw. The slider mechanism slideably mounts to the single guide member, and the auger rotationally mounts to the slider mechanism. The single threaded screw is oriented substantially parallel to the single guide member and threadably engages the slider mechanism. The auger rotationally mounts to the slider mechanism, wherein rotational motion of the single threaded screw causes the slider mechanism to slide along the single guide member, to rectilinearly translate the auger, and to vary the depth of the bored hole. An auger drive system couples to the auger and mounts to the slider mechanism. The auger drive system comprises a means for rotating the auger. A support structure has a forward portion for attachment to the vehicle, and the support structure has at least one of i) a rearward portion hinged to the forward portion and ii) the rearward portion pivotally attached to the single guide member. The rearward portion may orient the single guide member in a direction substantially parallel to a longitudinal axis of the vehicle. The rearward portion may also orient the single guide member in a direction transverse to the vehicle. The single supporting guide member and the single threaded screw improve maneuverability and accuracy in corners and in confined areas, and the support structure allows the single guide member, and thus the auger, to be oriented for boring the hole at a desired angle.

Still another embodiment also describes a posthole digger for boring a hole in the earth. The posthole digger mounts to a vehicle for maneuvering along a fence line. An auger rectilinearly translates along a single guide member. The single guide member has a substantially single point of contact with the earth to counteract a force produced by the auger. The single point of contact provides a smaller footprint and thereby improving the accuracy of boring the hole on an inclined surface. A power screw system for rectilinearly translating the auger comprises a single threaded screw, a slider mechanism, a hydraulic drive sprocket, a screw sprocket, and a supply of pressurized hydraulic fluid in fluid flow communication with the hydraulic drive sprocket. The slider mechanism slideably mounts to the single guide member and the auger rotationally mounts to the slider mechanism. The single threaded screw orients substantially parallel to the single guide member and threadably engages the slider mechanism. The auger rotationally mounts to the slider mechanism. The hydraulic drive sprocket rotatably mounts to the single guide member, and the screw sprocket also rotatably mounts to the single guide member and couples to the single power screw. The pressurized hydraulic fluid flows through the hydraulic drive sprocket and rotates the hydraulic drive sprocket, the hydraulic drive sprocket rotates the coupled screw sprocket, and the single power screw, coupled to the screw sprocket, rotates. The rotational motion of the single threaded screw causes the slider mechanism to slide along the single guide member, to rectilinearly translate the auger, and to vary the depth of the bored hole. An auger drive system couples to the auger and mounts to the slider mechanism. The auger drive system comprises a hydraulic drive sprocket, an auger sprocket, and a supply of pressurized hydraulic fluid in fluid flow communication with the hydraulic drive sprocket. The hydraulic drive sprocket rotatably mounts to the slider mechanism, the auger sprocket rotatably mounts to the slider mechanism and couples to the auger, and the hydraulic drive sprocket couples to the auger sprocket. The pressurized hydraulic fluid flows through the hydraulic drive sprocket and rotates the hydraulic drive sprocket, the hydraulic drive sprocket rotates the coupled auger sprocket, and the auger, coupled to the auger sprocket, rotates. A support structure has a forward portion and a rearward portion. The forward portion is for attachment to the vehicle. The rearward portion is hinged to the forward portion for orienting the single guide member in a direction substantially parallel to a longitudinal axis of the vehicle. The rearward portion also pivotally attaches to the single guide member, and the rearward portion for orienting the single guide member in a direction transverse to the vehicle. The single supporting guide member and the single threaded screw improve maneuverability and accuracy in corners and in confined areas, and the support structure allows the single guide member, and thus the auger, to be oriented for boring the hole at a desired angle.

An auger bit for an auger is also disclosed. The bit comprises an outer blade and a center bit. The outer blade comprises an outer ring and an inner hub. The outer ring has an array of circumferentially-spaced teeth along the outer ring. The inner hub is substantially concentric to the outer ring and inwardly spaced from the outer ring by an array of inner spokes. Each spoke in the array of inner spokes has a bladed portion for moving soil and cutting roots. The center bit inserts into the inner hub and comprises a drill bit-shaped tip, a toothed cone, and a shaft. The drill bit-shaped tip, the toothed cone, and the shaft all are concentrically aligned with the outer ring and with the inner hub. The toothed cone has at least one blade outwardly protruding from the toothed cone, and the shaft inserts into the inner hub to center the center bit with the outer ring and with the inner hub. The drill bit-shaped tip centers the auger bit, the array of circumferentially-spaced teeth moves soil and cuts roots, and the at least one blade outwardly protrudes from the toothed cone for moving soil and cutting roots.

FIG. 1 is a rear view of a boring machine 10 attached to a farm tractor 12. The boring machine 10 includes an auger 14 translating along a guide 16. The auger 14 is said to be in translation when the auger 14 keeps the same orientation during any motion. See FERDIAND P. BEER & E. RUSSELL JOHNSTON, JR., MECHANICS FOR ENGINEERS 583 (1976). Every particle forming the auger 14 moves in a parallel path. See id. Because each path is a straight line, the auger 14 is said to move in rectilinear translation. See id. The auger 14 thus rectilinearly translates along the guide 16 and allows the auger 14 to bore a straight hole.

The boring machine 10 also includes a power screw system 18 and an auger drive system 20. As those skilled in the art recognize, the power screw system 18 converts rotational motion into rectilinear motion. See CHARLES E. WILSON ET AL, KINEMATICS AND DYNAMICS OF MACHINERY 53 (1983). The power screw system 18 has a threaded screw 22 placed substantially parallel to the guide 16. The threaded screw 22 threadably engages a slider mechanism 24. The auger drive system 20 is coupled to the auger 14 and rotates the auger 14. As those skilled and unskilled in the art understand, as the threaded screw 22 rotates, the slider mechanism 24 moves along the threaded screw 22 and translates along the guide 16. Because the auger 14 is mounted to the slider mechanism 24, the auger 14 also translates along the guide 16. The guide 16 rests upon the ground and controls the rate at which the auger 14 feeds into the ground. Because the guide 16 rests upon the ground, the power screw system 18 and the auger drive system 20 need not be sized to transfer weight if the auger 14 encounters some obstruction.

Figure 2:
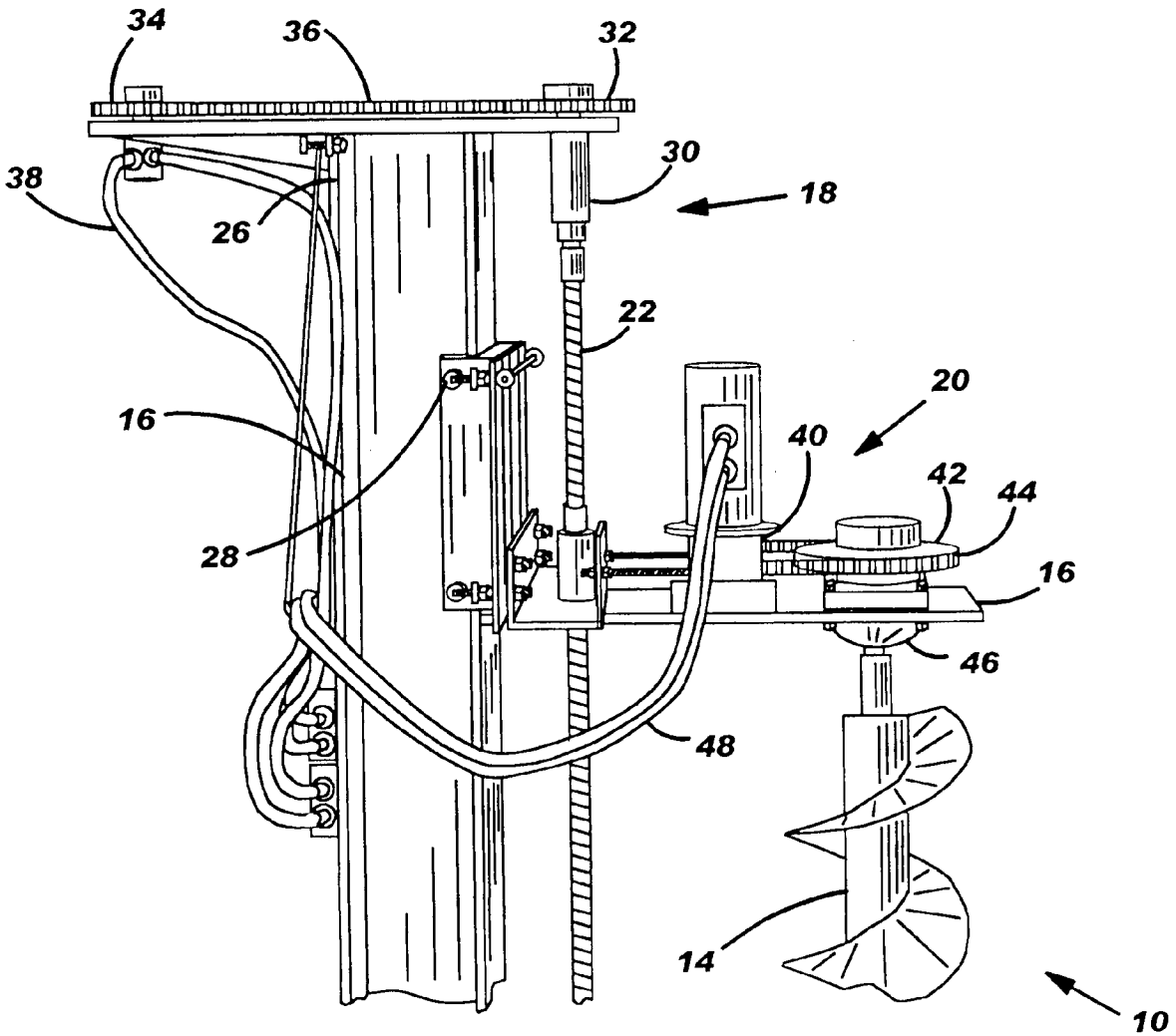
FIG. 2 is a partial side view of the boring machine showing the power screw system and the auger drive system as shown in FIG. 1.

FIG. 2 is a partial side view of the boring machine 10 showing the power screw system 18 and the auger drive system 20. The guide 16 is shown with the slider mechanism 24 positioned near a top portion 26 of the guide 16. The slider mechanism 24 slides along the guide 16 and may include at least one bearing 28 between the slider mechanism 24 and the guide 16. The threaded screw 22 is mounted to an upper shaft bearing 30. The upper shaft bearing 30 is mounted to the guide 16. The upper shaft bearing 30 includes a screw sprocket 32 coupled to a first hydraulic drive sprocket 34 by a first roller chain 36. Pressurized hydraulic fluid is supplied along a first hydraulic line 38 to the first hydraulic drive sprocket 34. As those skilled in the art understand, pressurized hydraulic fluid rotates the first hydraulic drive sprocket 34. The screw sprocket 32 rotates and also rotates the threaded screw 16. The pressure of the hydraulic fluid flowing through the first hydraulic drive sprocket 30 determines the rotational speed of the threaded screw 16. The slider mechanism 24, and the attached auger 14, translates in relation to a thread pitch and to the rotational speed of the threaded power screw 16.

The auger drive system 20 similarly operates. A second hydraulic drive sprocket 40 is mounted to the slider mechanism 24. The second hydraulic drive sprocket 40 is coupled to an auger sprocket 42 by a second roller chain 44. The auger sprocket 42 is concentrically mounted to an auger shaft bearing 46. The auger 14 is mounted to the auger shaft bearing 46. Pressurized hydraulic fluid is supplied along a second hydraulic line 48 to the second hydraulic drive sprocket 40. As those skilled in the art similarly understand, pressurized hydraulic fluid rotates the second hydraulic drive sprocket 40. The auger sprocket 42 rotates and causes the auger 14 to also rotate. The pressure of the hydraulic fluid flowing through the second hydraulic drive sprocket 40 determines the rotational speed of the auger 14.

Figure 3:
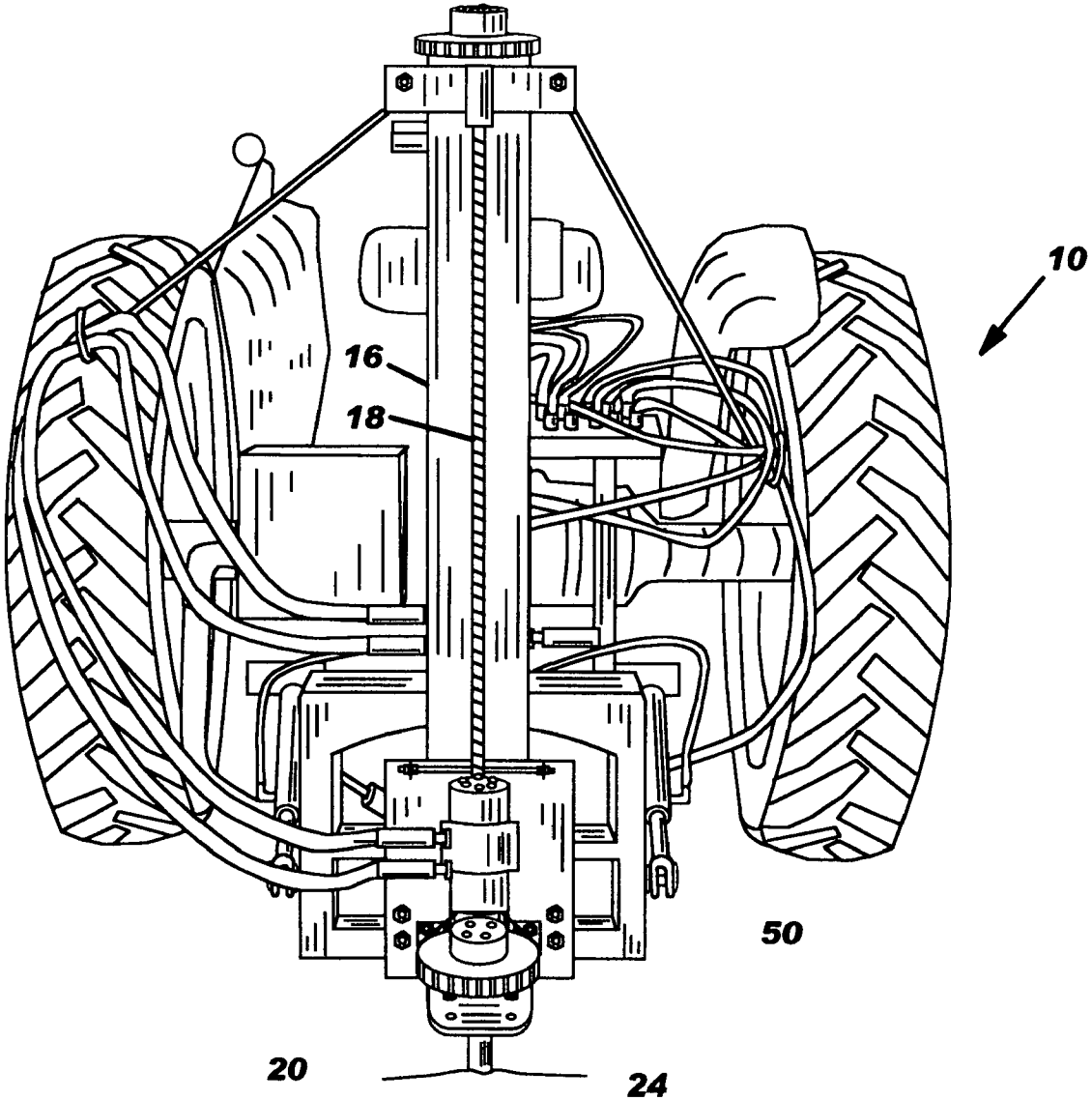
FIGS. 3–7 are also partial side views showing various orientations of the boring machine.

FIG. 3 is also a partial rear view of the boring machine 10. FIG. 3, however, shows the slider mechanism 24 positioned near a bottom portion 50 of the guide 16. The slider mechanism 24 is nearly fully translated to the bottom portion 50 of the guide 16. The auger (shown as reference numeral 14 in FIGS. 1 and 2) has bored below a surface of the ground.

Those skilled in the art recognize the power screw system 18 and the auger drive system 20 need not be hydraulically-driven. Electric motors may be alternative choices. Hydraulic operation, however, is very convenient when the boring machine 10 is mounted to a farm tractor (shown as reference numeral 12 in FIG. 1). The common power take-off (PTO) unit found on many farm tractors, and the many existing hydraulic PTO components, make reducing the boring machine 10 to practice a much easier and faster alternative.

Figure 4:
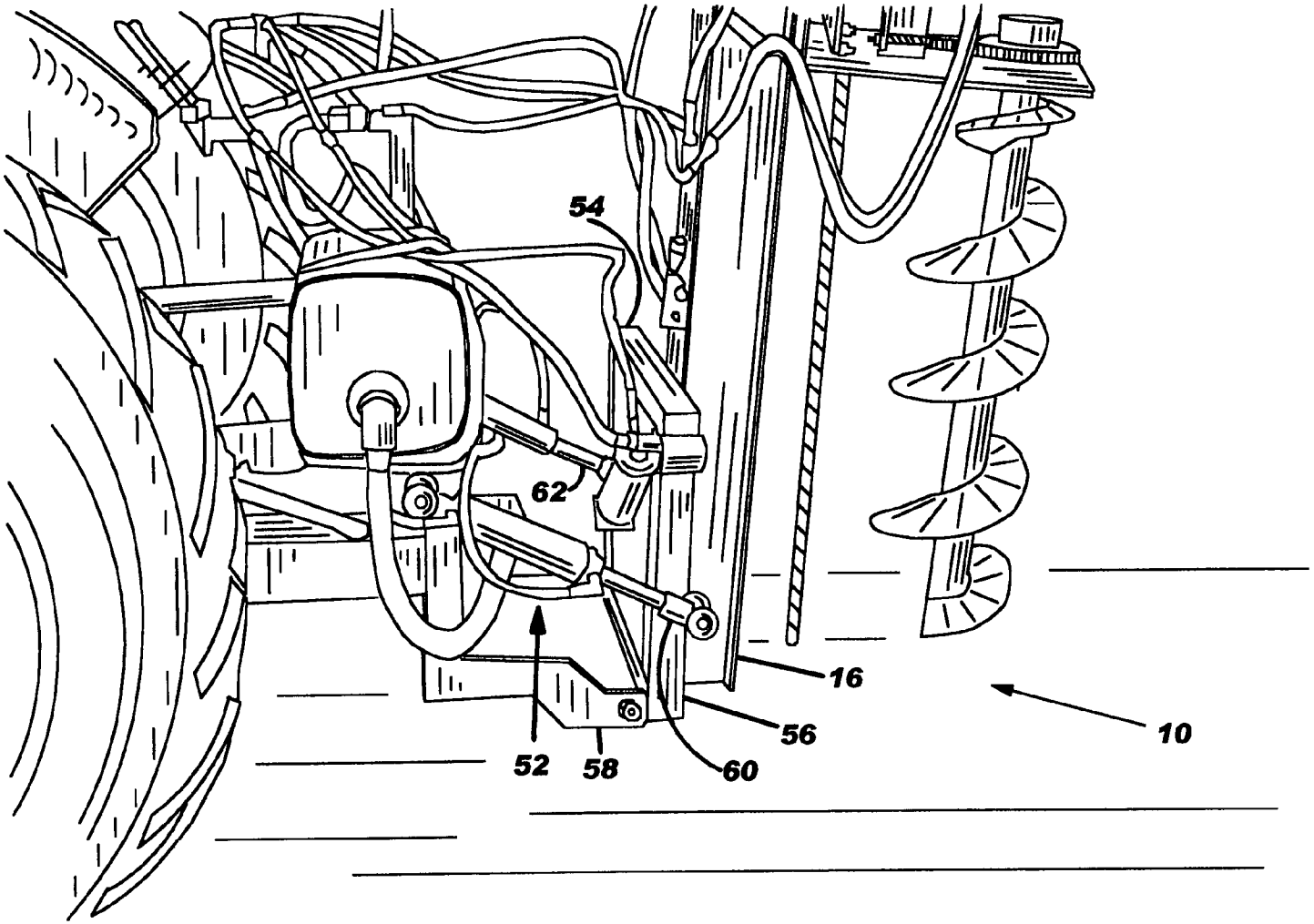
Figure 5:
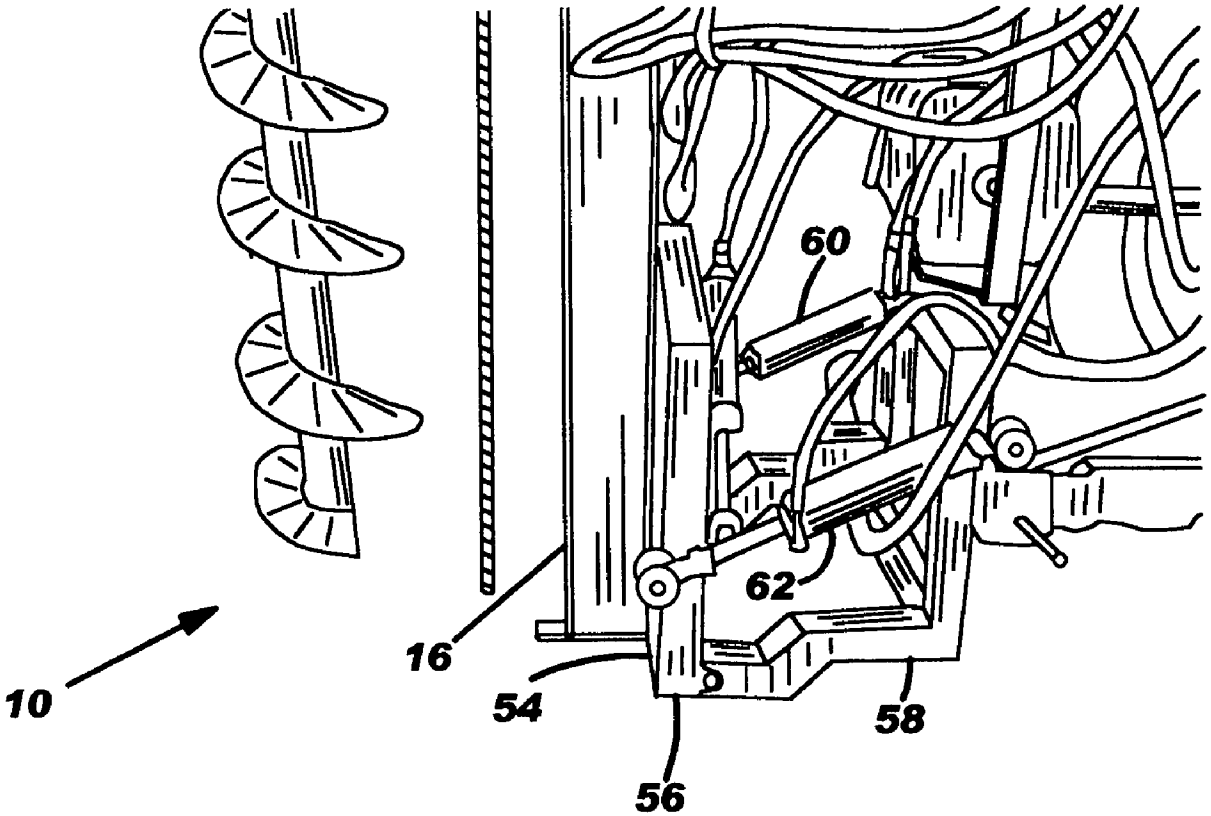

FIGS. 4 and 5 are also partial side views of the boring machine 10. These partial side views show an arrangement 52 of hydraulic cylinders for orienting the boring machine 10. The arrangement 52 of hydraulic cylinders can be actuated to adjust the orientation of the boring machine 10. As FIGS. 4 and 5 show, the guide 16 is attached to a support structure 54. The support structure 54 has a rearward portion 56 hinged to a forward portion 58. At least one hydraulic cylinder 60 is mounted between the forward portion 58 and the hinged rearward portion 56. Pressurized hydraulic fluid causes the at least one hydraulic cylinder 60 to expand or collapse and, thus, pivot the rearward portion 56. As the rearward portion 56 pivots, the attached guide 16 also pivots. While FIGS. 4 and 5 show a second hydraulic cylinder 62 also pivoting the rearward portion 56 and, thus, the guide 16, those skilled in the art recognize one or more hydraulic cylinders may be used to suit many design loads and many design alternatives.

Figure 6:
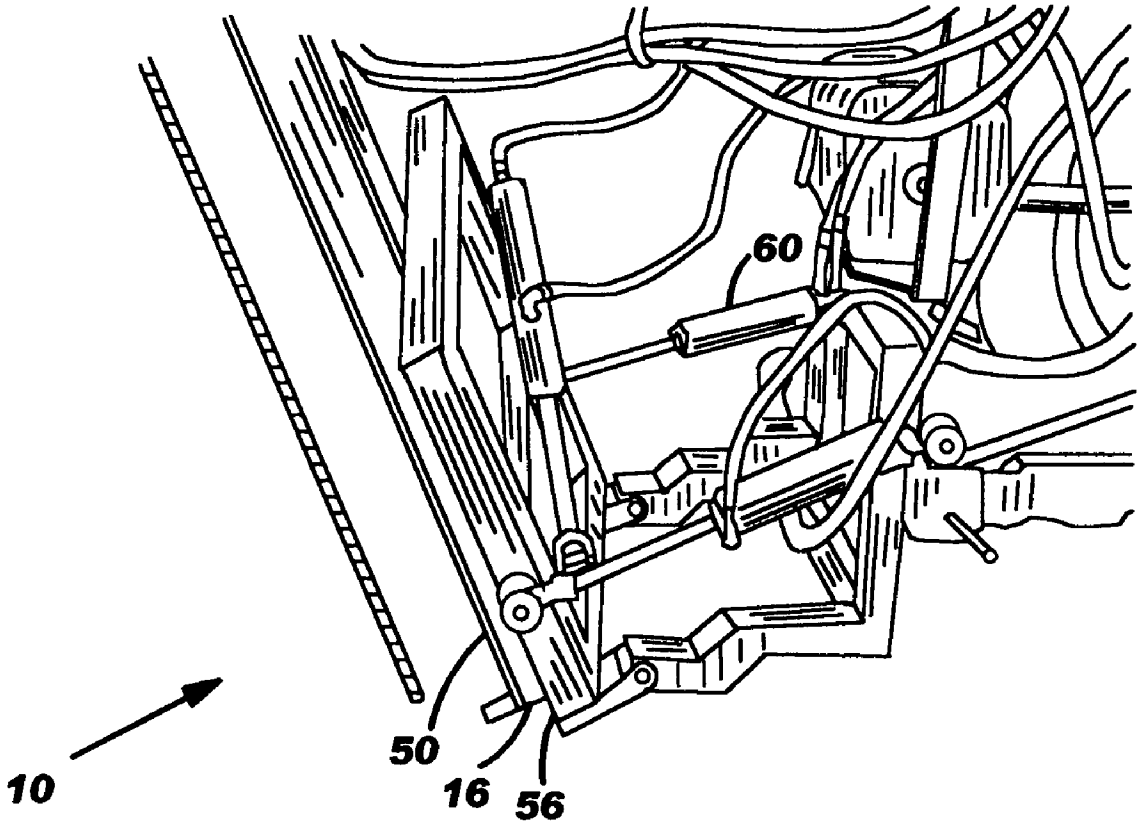
Figure 7:
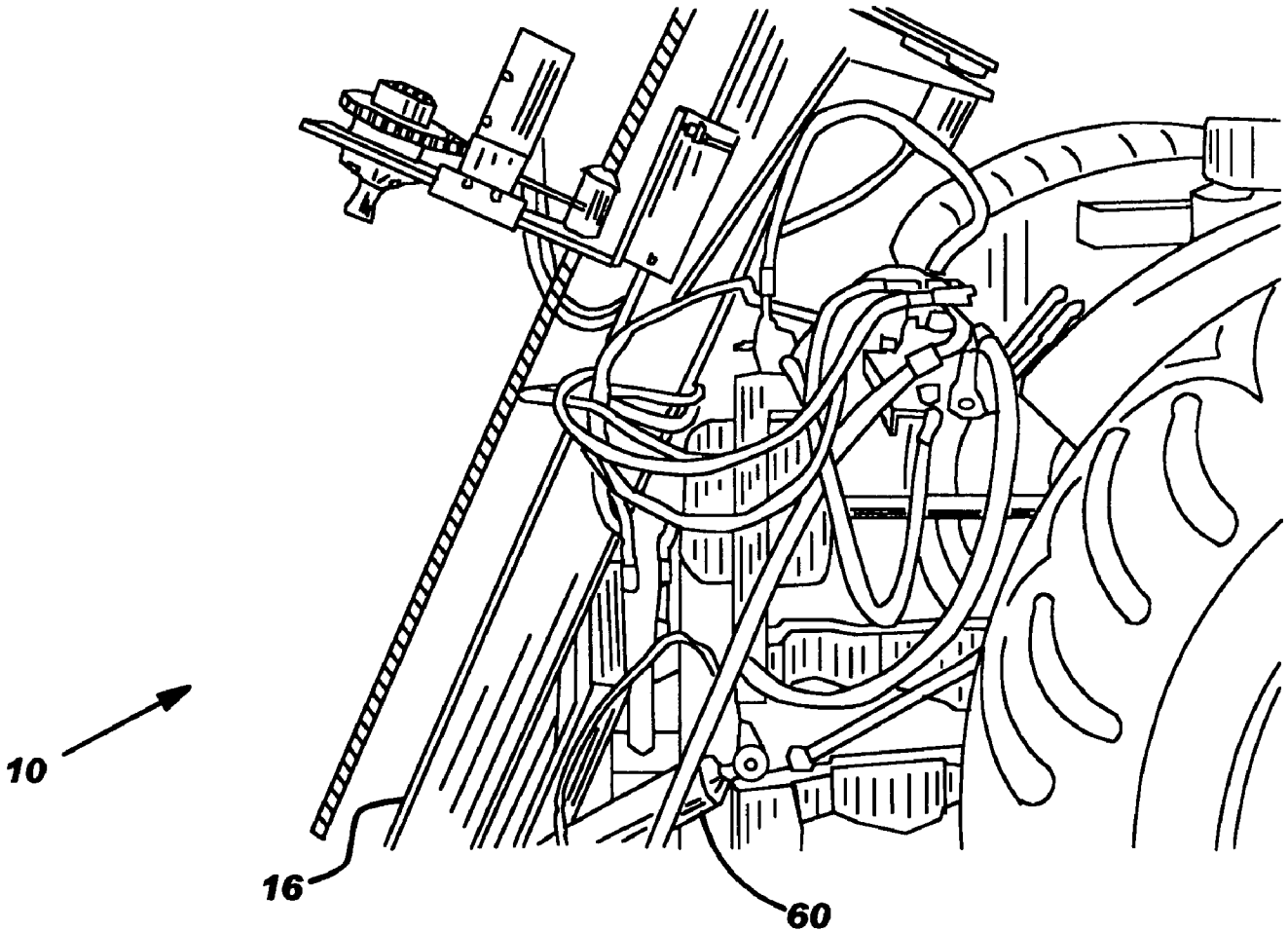

FIGS. 6 and 7 are also partial side views of the boring machine 10. These views, however, show the guide 16 oriented with respect to the ground. As FIG. 6 shows, pressurized hydraulic fluid has extended the at least one hydraulic cylinder 60. The rearward portion 56, and the attached guide 16, are pivoted to bore an angled hole with respect to ground level. The guide 16 can thus be longitudinally oriented to the farm tractor (shown as reference numeral 12 in FIG. 1). FIG. 6 shows the slider mechanism (shown as reference numeral 24 in FIG. 1) positioned near the bottom portion 50 of the guide 16. The auger (shown as reference numeral 14 in FIGS. 1 and 2) has bored below a surface of the ground. FIG. 7 also shows the guide 16 oriented to bore at an angle, however, the at least one hydraulic cylinder 60 is collapsed to bore a hole opposite to that shown in FIG. 6.

Figure 8:
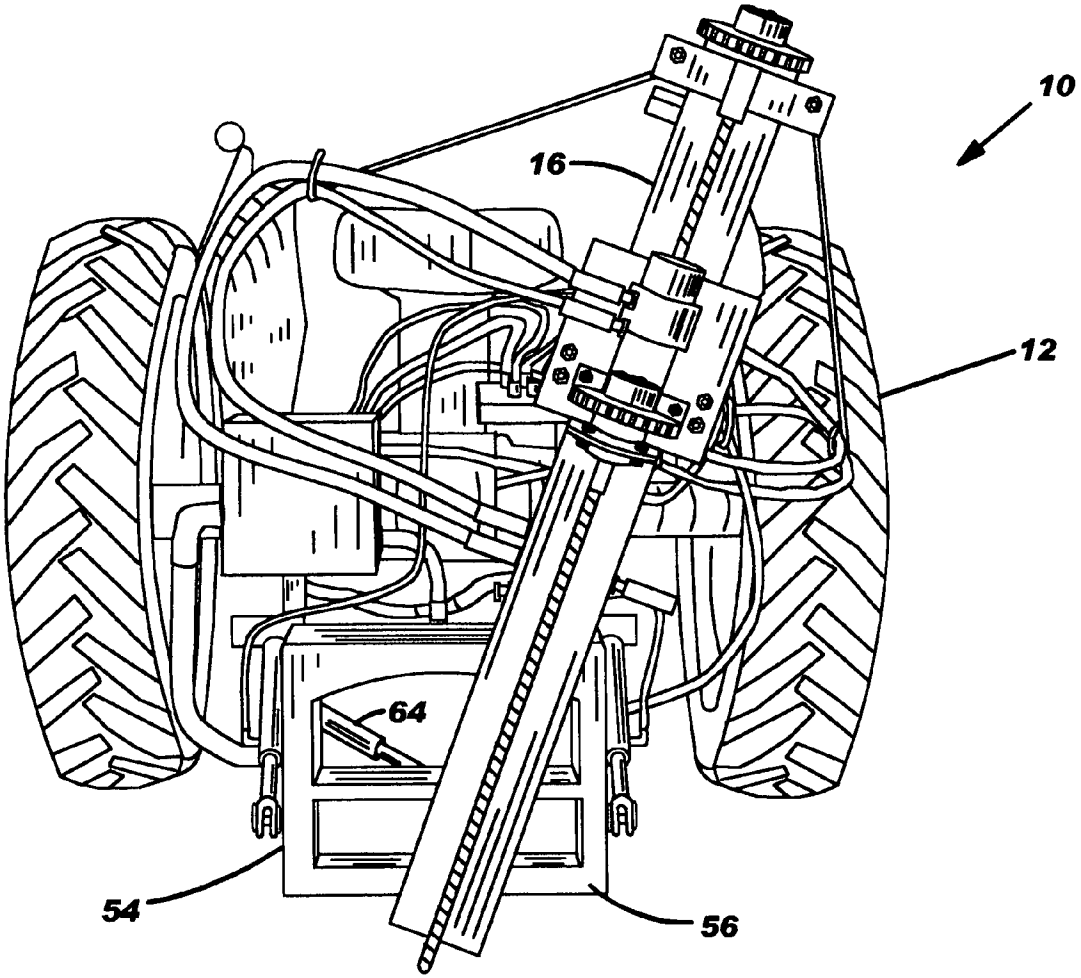
FIGS. 8 and 9 are rear views of the boring machine.
Figure 9:
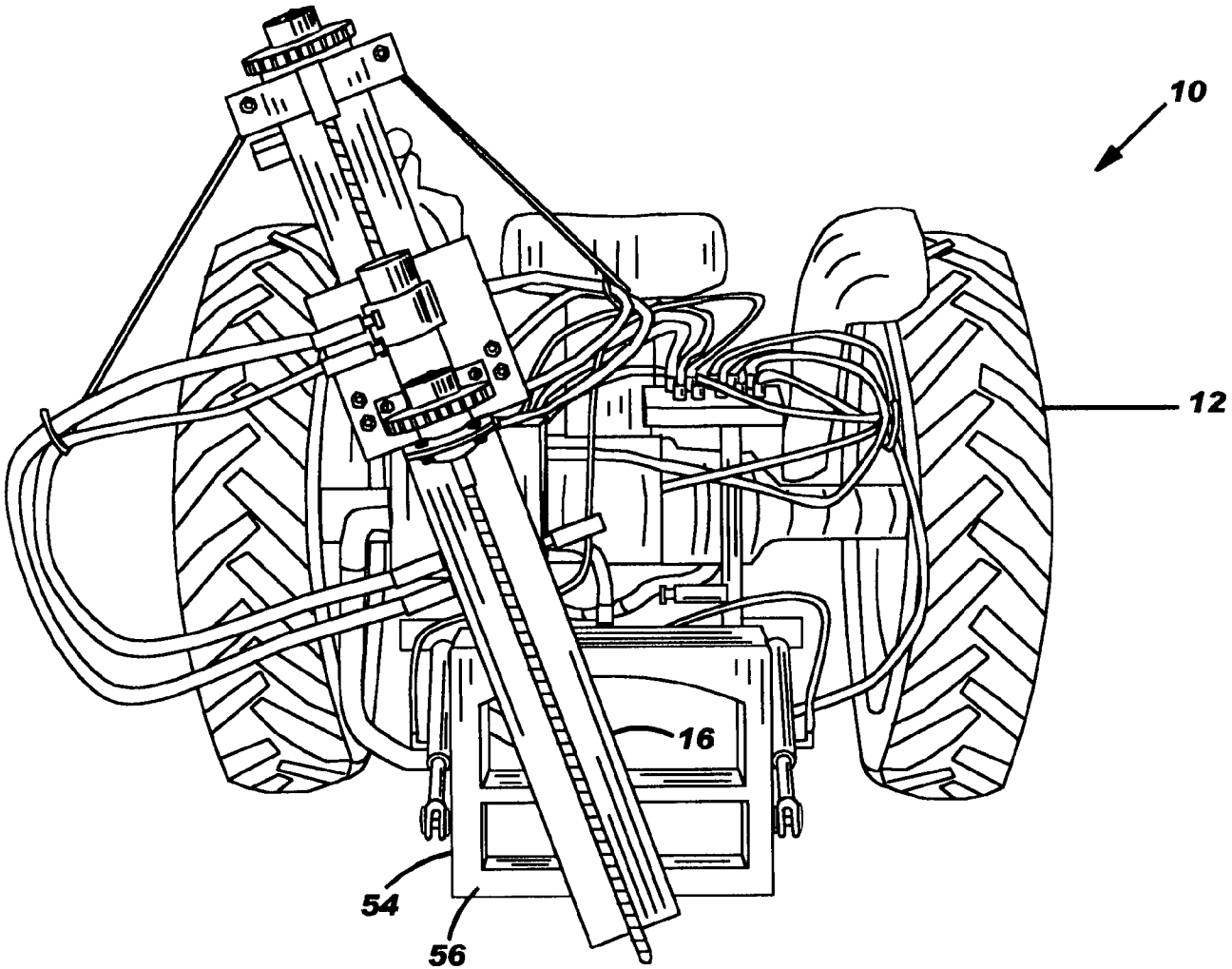

FIGS. 8 and 9 are rear views of the boring machine 10. These rear views, however, show the guide 16 can also be transversely oriented to the farm tractor 12. The guide 16 is pivotally mounted with respect to the rearward portion 56 of the support structure 54. A third hydraulic cylinder 64 is mounted between the rearward portion 56 and the guide 16. As pressurized hydraulic fluid extends the third hydraulic cylinder 64, guide 16 transversely pivots to bore an angled hole with respect to ground level. The guide 16 can thus be transversely oriented to the farm tractor 12. FIG. 8 shows the guide 16 transversely pivoted in a clockwise direction, while FIG. 9 shows the guide 16 transversely pivoted in a counter-clockwise direction. Both FIGS. 8 and 9 show the auger (shown as reference numeral 14 in FIGS. 1 and 2) bored below a surface of the ground.

Figure 10:
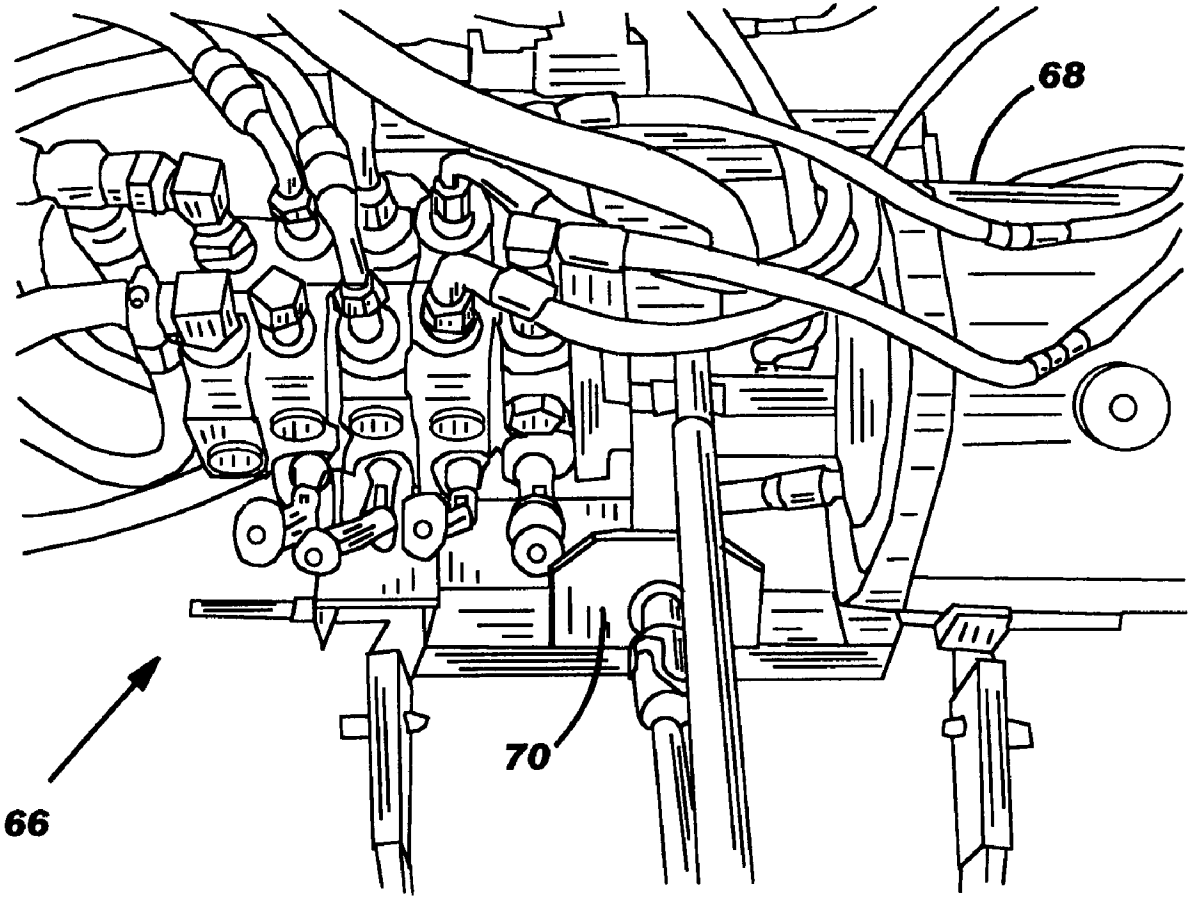
FIG. 10 shows a system of hydraulic valves for operating the boring machine.

FIG. 10 shows a system 66 of hydraulic valves. As those skilled in the art understand, this system 66 of hydraulic valves controls hydraulic fluid flow through the boring machine (shown as reference numeral 10 in FIG. 1). A reservoir 68 supplies hydraulic fluid, and a pump 70 pressurizes the hydraulic fluid. The pump 70 is driven by the power take-off (PTO) unit.

The auger machine of the present invention is operable by a single lever. Even though a power take-off unit may be rotating, a single lever is used to engage a hydraulic pump. Thus, if the PTO is rotating, the single lever must be engaged for the auger to rotate. This safety precaution is another significant advantage of the current design. Without the single lever engaged, the hydraulic pump does not operate, and the auger does not rotate, even if the tractor is running. This same lever could also control the rotational speed of the auger.

Other single levers may also be used to control the orientation of the auger. A lever, for example, could be used to control the longitudinal axis of the auger, while another lever could control the transverse axis. Yet another lever could control the auger's rotational speed, while a fourth lever could control the rotational direction of the threaded rod, thus raising and lowering the auger. This system of four (4) levers thus allows an operator, sitting in the seat of the tractor, to control the operation of the auger. This system of single lever controls would preferably be spring loaded, such that hydraulic action is stopped when hand pressure is released. This lever system thus further improves the safety of the present design, preventing the operator from getting close to the rotating auger.

The single guide design is an improvement. The single guide, and the single threaded rod, allow the auger machine to access corners. Because the threaded rod is longitudinally displaced from the single guide, maneuverability is further improved. The single guide sits upon the ground to counteract auger forces and helps reduce tipping of the tractor. The smaller footprint of the single guide also allows the use of a smaller horsepower tractor to hydraulically rotate the auger, thus further improving maneuverability and economy. The small cross-section of the single guide also permits a very accurate starting bore.

One improvement involves a hydraulic reservoir. An interior volume of the rearward portion (shown as reference numeral 56 in FIGS. 6 and 7) could be used to contain the hydraulic fluid. This arrangement would also permit greater heat transfer from the hot fluid to the surrounding ambient air. Any portion of the auger machine, having an interior volume, could accommodate hydraulic fluid, but the rearward portion is more proximate to the hydraulic valves and hydraulic cylinders.

Another improvement utilizes threaded rods to orient the single guide member 16. Although hydraulic cylinders are shown in FIGS. 4 and 5, threaded rods could be used to orient the single guide member 16 and, thus, the auger 14. The threaded rods would be threadably mounted between the single guide member 16 and the support structure 54. Hydraulic motors, or electrical motors, could rotate the threaded rods and, thus, orient the single guide member 16 and the auger 14. The threaded rods could also be mounted within swivel bearings, or other suitable bearings, to accommodate changes in orientation.

Still another improvement incorporates sensors to orient the guide member 16. Often an operator will want to vertically orient the single guide member 16 when, for example, boring holes along a hillside. Sensors could be used to detect when the single guide member 16 is oriented to a true vertical position. These sensors could interface with a feedback mechanism and provide a means for automatically orienting the single guide member 16. These sensors, too, could help detect when the single guide member 16 is fifteen degrees (15°), thirty degrees (30°), or any other desired orientation. The operator could then select the desired orientation and rely upon the means for automatically orienting the single guide member 16.

FIGS. 11–14 show an auger bit 72. This auger bit 72 mounts to the auger 14 and is used to bore holes in the ground. The auger bit 72 is especially useful to accurately bore holes in root-infested soil. An accurately bored hole is necessary when, for example, boring fence post holes. A centerline must be maintained to avoid slow manual digging. The auger bit 72 of the present invention eliminates side-stepping when tree roots are encountered.

Figure 11:
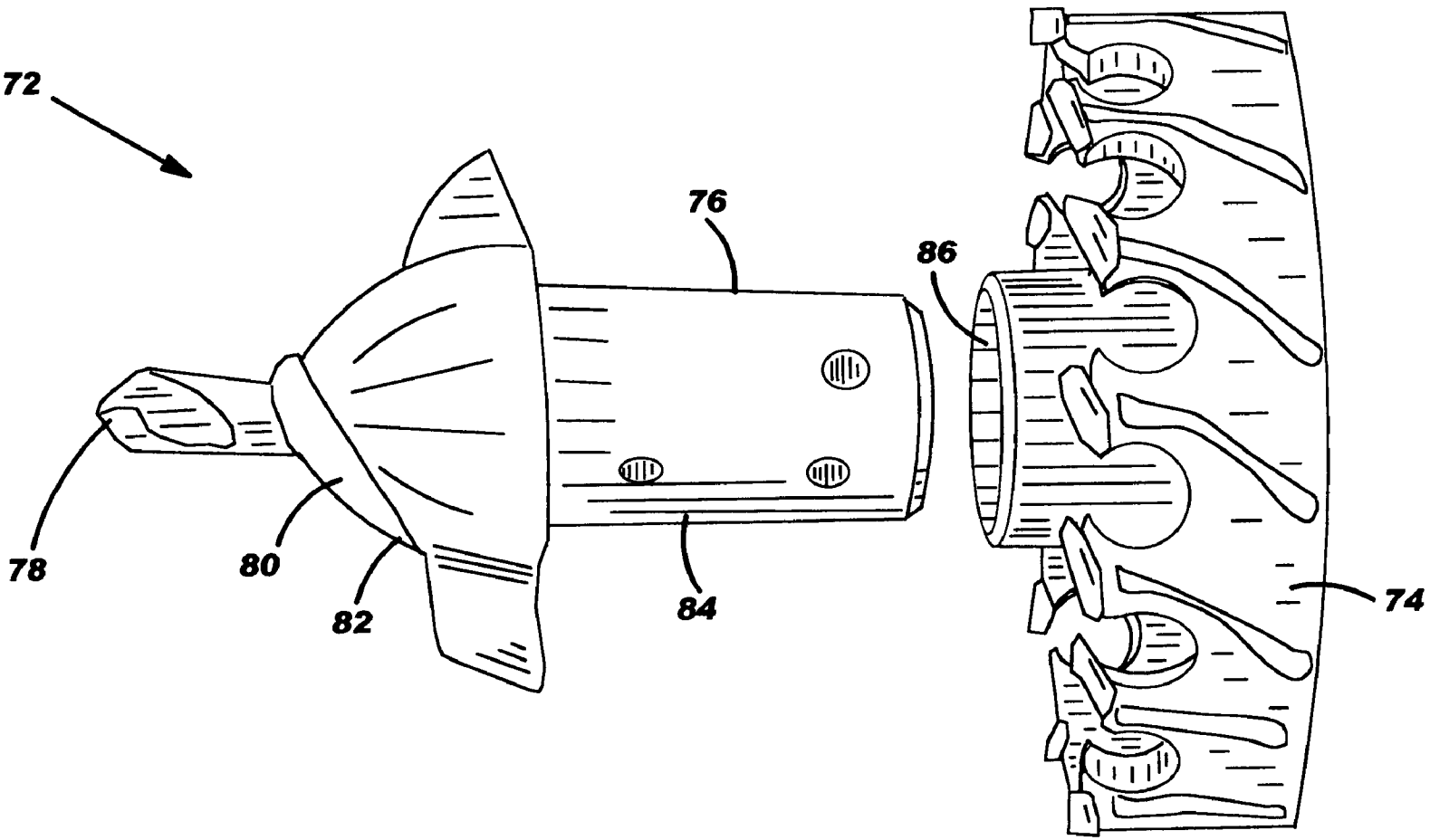
FIGS. 11–14 show an auger bit for use with the boring machine.

FIG. 11 is a side view of the auger bit 72. The auger bit 72 includes a toothed outer blade 74 and a center bit 76. The center bit 76 includes a drill bit 78 for centering the auger bit 72. The drill bit 78 transitions to a toothed cone 80. The toothed cone 80 enlarges from the drill bit 78. The toothed cone 80 has at least one blade protruding from a conical portion 82 of the toothed cone 80. The center bit includes a shaft portion 84 rearwardly extending from the toothed cone 80. The shaft portion 84 slides within an inner hub 86 of the toothed outer blade 74.

Figure 12:
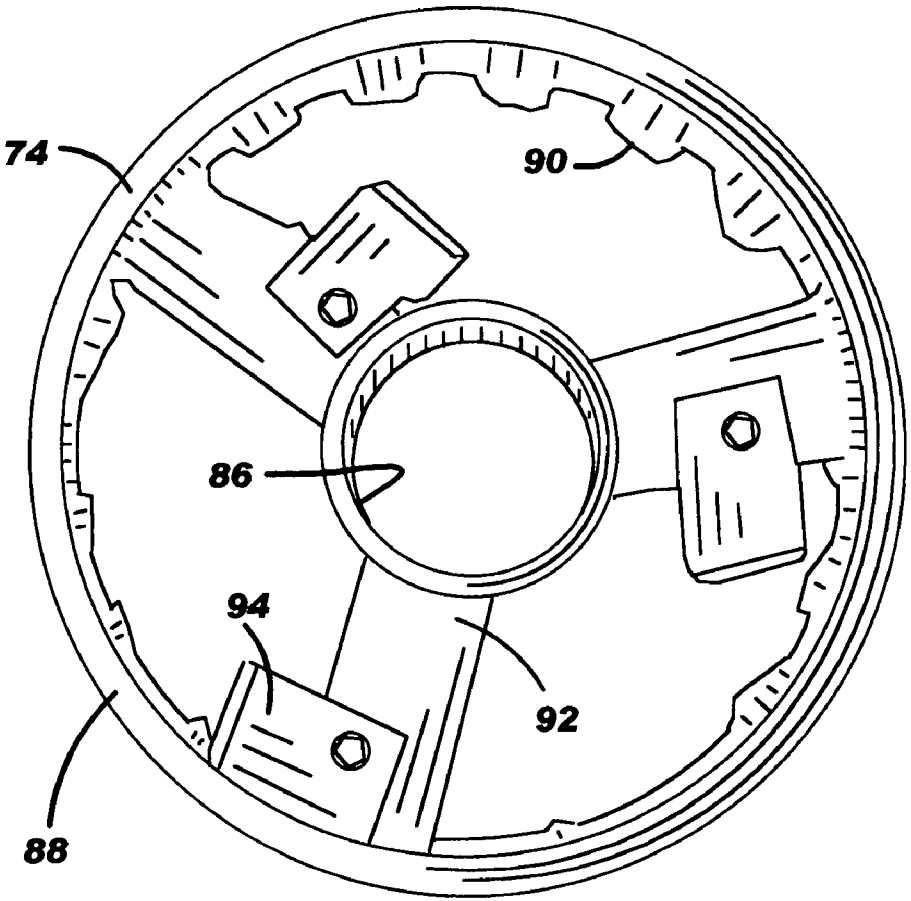

FIG. 12 is a top view of the toothed outer blade 74. The toothed outer blade 74 includes the inner hub 86 and an outer ring 88. The toothed outer blade 74 includes an array of teeth 90 for moving soil and cutting roots. The array of teeth 90 may be equally spaced along a circumference of the outer ring 88, or the array of teeth 90 may be randomly spaced. An array of inner spokes 92 maintains the inner hub 86 concentrically spaced from the outer ring 88. Each spoke of the array of inner spokes 92 includes a bladed portion 94 for also moving soil and cutting roots.

Figure 13:
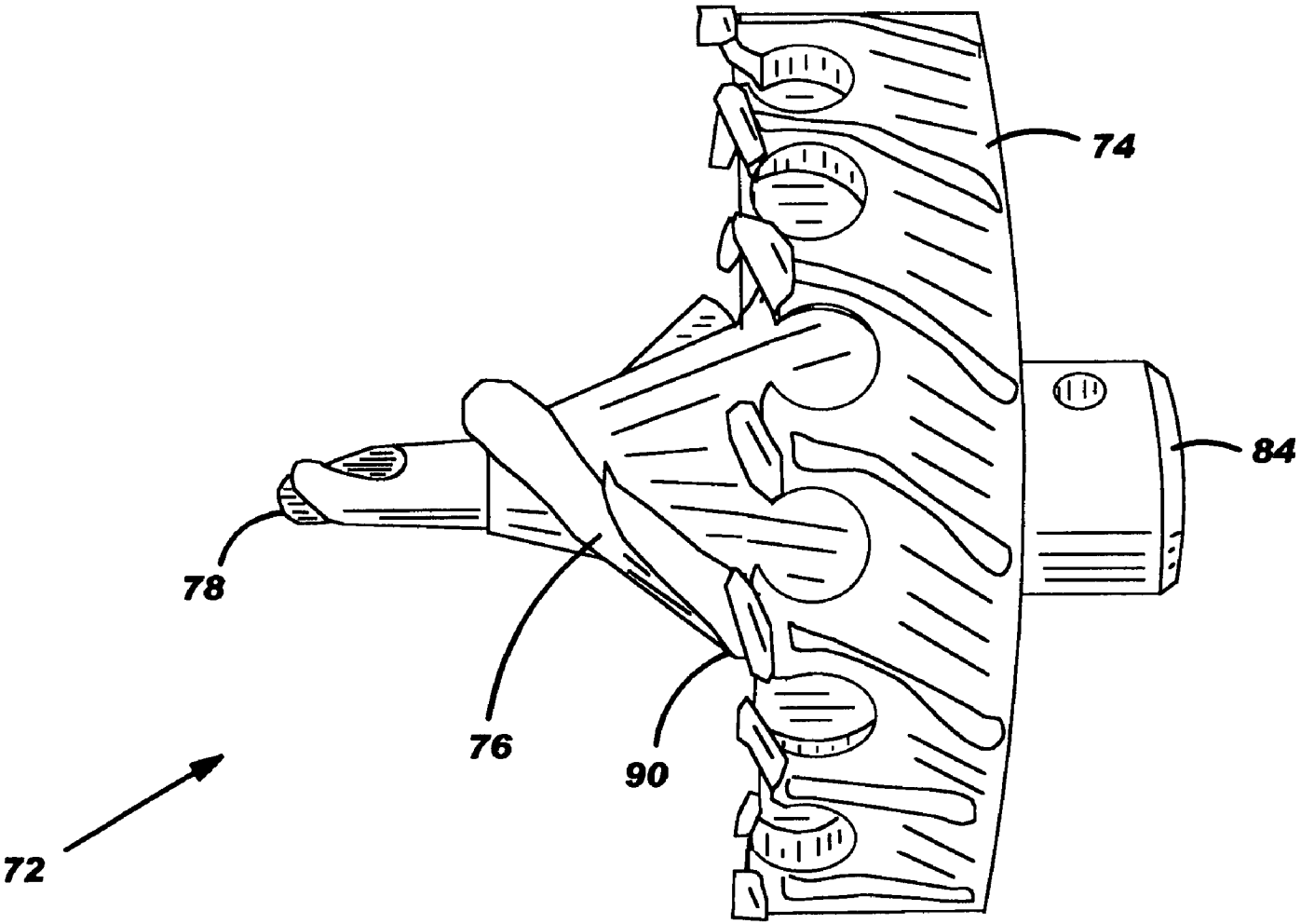
Figure 14:
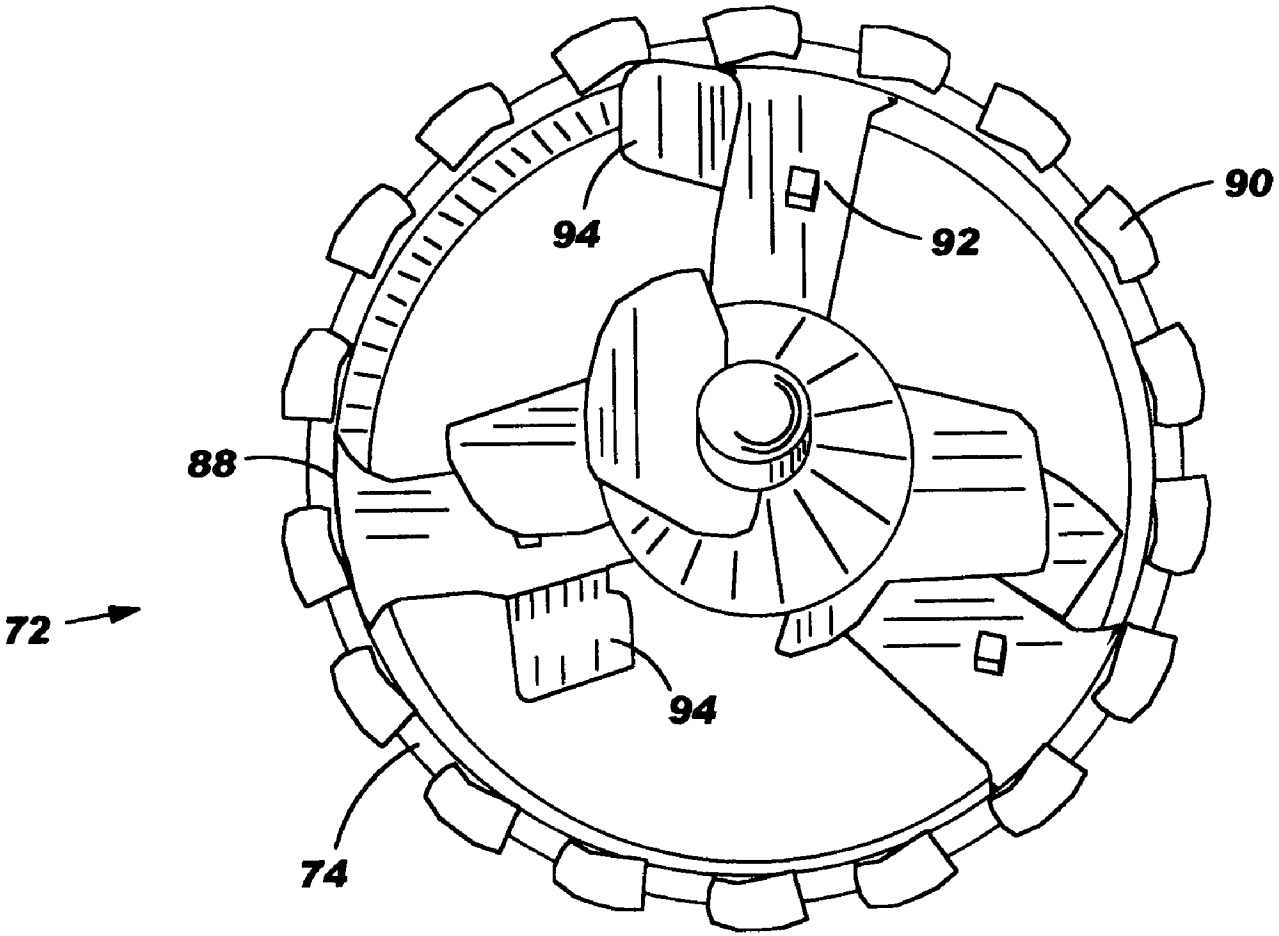

FIGS. 13 and 14 are, respectively, side and top views of the auger bit 72.

Another improvement allows the auger bit 72 to rotate independently of the auger 14. If the auger 14 rotated faster than the auger bit 72, the auger 14 could quickly lift and remove material to help keep the auger bit 72 free of rocks, roots, and other material. When boring a hole, for example, gravity often prevents the auger 14 from removing material fast enough to keep the auger bit 72 clear. If, however, the auger 14 rotated faster than the auger bit 72, the auger 14 could lift material faster than the auger bit 72 removes.

Concentric shafts would allow the auger bit 72 to rotate independently of the auger 14. The auger 14 would include a hollow central shaft, while the auger bit 72 would be attached to an inner shaft. The inner shaft would be concentric to the outer, hollow shaft, such that the inner shaft rotates within the outer hollow shaft (more commonly known as a "shaft within a pipe"). The outer hollow shaft could be rotated at a faster speed than the inner shaft, thus allowing the auger 14 to quickly remove material and help keep the auger bit 72 clear.

The present invention also contemplates a method. The method of boring holes in the ground includes rectilinearly translating an auger with respect to the ground and boring a hole in the ground with the auger. The auger is rectilinearly translated along a single guide member by a single threaded screw. The method may also include longitudinally and transversely orienting the auger.

Because the slider mechanism 24 slides along the guide 16, the boring machine 10 may include the at least one bearing 28 between the slider mechanism 24 and the guide 16. The at least one bearing 28 may utilize ball bearings, roller bearings, acetal resin compounds (e.g., DELRIN® resin as marketed and sold by E. I. du Pont de Nemours and Company), and nylon. The guide 16 and/or the slider mechanism 24, alternatively, may include a low-friction coating such as polytetrafluoroethylene (e.g., TEFLON® plastic as marketed and sold by E. I. du Pont de Nemours and Company).

While the present invention has been described with respect to various features, aspects, and embodiments, those skilled and unskilled in the art will recognize the invention is not so limited. Other variations, modifications, and alternative embodiments may be made without departing from the spirit and scope of the present invention. Those skilled in the art, for example, readily recognize the boring machine described in this application may be dimensionally altered to suit many design requirements.

What is claimed is:

1. An auger bit for an auger, the auger for boring a hole, the auger bit comprising:

an outer blade, the outer blade comprising an outer ring and an inner hub, the outer ring having an array of circumferentially-spaced teeth along the outer ring, with each tooth fixed in one position, parallel to the outer ring, the inner hub substantially concentric to the outer ring, the inner hub inwardly spaced from the outer ring by an array of inner spokes, each spoke in the array of inner spokes having a bladed portion for removing material;

a center bit inserted into the inner hub, the center bit comprising a drill bit-shaped tip, a toothed cone, and a shaft the drill bit-shaped tip, the toothed cone, and the shaft all concentrically aligned with the outer ring and with the inner hub, the toothed cone having at least one blade outwardly protruding from a conical portion, the blade having an edge, and the shaft inserting into the inner hub to center the center bit with the outer ring and with the inner hub, wherein the drill bit-shaped tip centers the auger bit, the array of circumferentially-spaced teeth for moving soil and cutting roots, and the at least one blade outwardly protruding from the toothed cone also for moving soil and cutting roots.

2. An auger bit according to claim 1, wherein the array of circumferentially-spaced teeth are equally spaced along the outer ring.

3. An auger bit according to claim 1, wherein the array of circumferentially-spaced teeth are randomly spaced along the outer ring.

* * * * *